US011657755B1

(12) United States Patent
Pai

(10) Patent No.: US 11,657,755 B1
(45) Date of Patent: May 23, 2023

(54) DISPLAY APPARATUS, DISPLAY DRIVING CIRCUIT AND DISPLAY DRIVING METHOD FOR GENERATING COMPENSATED GAMMA CURVE

(71) Applicant: Novatek Microelectronics Corp., Hsinchu (TW)

(72) Inventor: Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/741,485

(22) Filed: May 11, 2022

(30) Foreign Application Priority Data

Jan. 12, 2022 (TW) ..... 111101247

(51) Int. Cl.
*G09G 3/32* (2016.01)

(52) U.S. Cl.
CPC ..... *G09G 3/32* (2013.01); *G09G 2300/0809* (2013.01); *G09G 2310/08* (2013.01); *G09G 2320/0233* (2013.01); *G09G 2320/0242* (2013.01); *G09G 2320/0673* (2013.01); *G09G 2330/021* (2013.01); *G09G 2340/16* (2013.01); *G09G 2360/10* (2013.01)

(58) Field of Classification Search
None
See application file for complete search history.

(56) References Cited

U.S. PATENT DOCUMENTS 8,232,987 B2 7/2012 Park et al.
8,319,802 B2 11/2012 Chen et al.
2011/0025722 A1 2/2011 Chen et al.
2012/0032998 A1* 2/2012 An ..... G09G 3/3696 345/213
2017/0193900 A1 7/2017 Kwon et al.
2019/0340980 A1* 11/2019 Yum ..... G09G 3/3258
2020/0082761 A1 3/2020 Kim
2020/0184887 A1* 6/2020 Nien ..... G09G 3/3225
2021/0264833 A1 8/2021 Heo et al.
2021/0358443 A1* 11/2021 Chen ..... G09G 3/3648

FOREIGN PATENT DOCUMENTS

TW 201104661 2/2011

OTHER PUBLICATIONS

"Office Action of Taiwan Counterpart Application", dated Oct. 14, 2022, p. 1-p. 5.

* cited by examiner

*Primary Examiner* — Chad M Dicke
(74) *Attorney, Agent, or Firm* — JCIPRNET

(57) ABSTRACT

A display driving circuit configured to drive a display panel to display a video is provided. The display driving circuit includes a compensating circuit and a gamma voltage generating circuit. The compensating circuit is configured to receive a voltage compensating map of each frame of the video and a pixel line address. The compensating circuit determines a voltage compensating value of each pixel line according to the voltage compensating map of each frame and the pixel line address. The compensating circuit generates a compensated gamma curve of each pixel line. The gamma voltage generating circuit is coupled to the compensating circuit. The gamma voltage generating circuit is configured to generate a gamma voltage of each pixel line according to the compensated gamma curve.

18 Claims, 8 Drawing Sheets

DISPLAY APPARATUS, DISPLAY DRIVING CIRCUIT AND DISPLAY DRIVING METHOD FOR GENERATING COMPENSATED GAMMA CURVE

CROSS-REFERENCE TO RELATED APPLICATION

This application claims the priority benefit of Taiwan application serial no. 111101247, filed on Jan. 12, 2022. The entirety of the above-mentioned patent application is hereby incorporated by reference herein and made a part of this specification.

BACKGROUND

Technical Field

The invention relates to an electronic apparatus, a driving circuit and a driving method, and particularly relates to a display apparatus, a display driving circuit and a display driving method.

Description of Related Art

In current driving displays, driving voltages provided by a power supply may have different levels of IR drops at different positions of a power supply trace due to changes in display content. When display content is the same, since distances from the power supply vary, pixels may receive driving voltages different from the originally expected under the influence of the IR drops, and different levels of variations may be present, which results in a difference between a display luminance of the pixel and an expected display luminance or undesirable phenomena such as uneven luminance, color deviation, and the like.

SUMMARY

The invention is directed to a display apparatus, a display driving circuit and a display driving method. The display driving circuit uses the display driving method provided by the embodiment of the invention to drive a display panel, by which a display luminance of pixels is more consistent with an expected luminance, and undesirable phenomena such as uneven luminance, color deviation, and the like, are eliminated.

The invention provides a display apparatus configured to display a video. The display apparatus includes a timing controller, one or a plurality of display driving circuits, and a display panel. The timing controller is configured to analyze content of each frame of the video according to video data to generate a voltage compensation map of the each frame. The display driving circuit is coupled to the timing controller. The display driving circuit is configured to receive the voltage compensation map and a pixel line address from the timing controller. The display driving circuit determines a voltage compensating value of each pixel line according to the voltage compensation map of the each frame and the pixel line address. The display driving circuit generates a first gamma curve of the each pixel line according to the voltage compensating value. The display panel is coupled to the display driving circuit. The display panel includes one or a plurality of display regions. The display driving circuit generates a gamma voltage of the each pixel line according to the first gamma curve to drive the respective display regions to display the video.

In an embodiment of the invention, the display driving circuit includes a compensating circuit and a gamma voltage generating circuit. The compensating circuit is coupled to the timing controller. The compensating circuit is configured to receive the voltage compensation map of the each frame and the pixel line address from the timing controller. The compensating circuit determines the voltage compensating value of the each pixel line according to the voltage compensation map of the each frame and the pixel line address. The compensating circuit generates the first gamma curve of the each pixel line according to the voltage compensating value. The gamma voltage generating circuit is configured to generate the gamma voltage of the each pixel line according to the first gamma curve.

In an embodiment of the invention, the voltage compensation map of the each frame includes the voltage compensating value of a plurality of first pixel points.

In an embodiment of the invention, the voltage compensation map of the each frame further includes the voltage compensating value of a plurality of second pixel points. The timing controller performs an interpolation operation on the voltage compensating value of the first pixel points to generate the voltage compensating value of the second pixel points.

In an embodiment of the invention, the timing controller outputs the voltage compensation map of the each frame to the compensating circuit during a vertical blanking period.

In an embodiment of the invention, the timing controller outputs the pixel line address to the compensating circuit during the vertical blanking period or an active period.

In an embodiment of the invention, the display driving circuit includes a second gamma curve. The display driving circuit adjusts the second gamma curve according to the voltage compensating value to generate the first gamma curve of the each pixel line.

The invention provides a display driving circuit configured to drive a display panel to display a video. The display driving circuit includes a compensating circuit and a gamma voltage generating circuit. The compensating circuit is configured to receive a voltage compensation map of each frame of the video and a pixel line address. The compensating circuit determines a voltage compensating value of each pixel line according to the voltage compensation map of the each frame and the pixel line address. The compensating circuit generates a first gamma curve of the each pixel line according to the voltage compensating value. The gamma voltage generating circuit is coupled to the compensating circuit. The gamma voltage generating circuit is configured to generate a gamma voltage of the each pixel line according to the first gamma curve.

In an embodiment of the invention, the voltage compensation map of the each frame includes the voltage compensating values of a plurality of first pixel points and a plurality of second pixel points. The voltage compensating value of the second pixel points is generated by performing an interpolation operation on the voltage compensating value of the first pixel points.

In an embodiment of the invention, the compensating circuit receives the voltage compensation map of the each frame during a vertical blanking period.

In an embodiment of the invention, the compensating circuit receives the pixel line address during the vertical blanking period or an active period.

In an embodiment of the invention, the gamma voltage generating circuit includes a second gamma curve. The compensating circuit adjusts the second gamma curve according to the voltage compensating value to generate the first gamma curve of the each pixel line.

In an embodiment of the invention, the compensating circuit receives the voltage compensation map of the each frame and the pixel line address from a timing controller.

In an embodiment of the invention, the display driving circuit further includes the timing controller. The timing controller is coupled to the compensating circuit. The timing controller analyzes content of the each frame according to video data to generate the voltage compensation map of the each frame.

The invention provides a display driving method for driving a display panel to display a video. The display driving method includes: analyzing content of each frame of the video according to video data to generate a voltage compensation map of the each frame; determining a voltage compensating value of each pixel line according to the voltage compensation map of the each frame and a pixel line address, and generating a first gamma curve of the each pixel line according to the voltage compensating value; generating a gamma voltage of the each pixel line according to the first gamma curve; and driving the display panel to display the video according to the gamma voltage of the each pixel line.

In an embodiment of the invention, the voltage compensation map of the each frame includes the voltage compensating values of a plurality of first pixel points and a plurality of second pixel points. The display driving method further includes: performing an interpolation operation on the voltage compensating value of the first pixel points to generate the voltage compensating value of the second pixel points.

In an embodiment of the invention, the step of generating the first gamma curve of the each pixel line according to the voltage compensating value includes: adjusting a second gamma curve according to the voltage compensating value to generate the first gamma curve of the each pixel line.

To make the aforementioned more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

The following embodiments are provided to describe the invention in detail, but the invention is not limited to the provided embodiments, and the provided embodiments may be suitably combined. The term "coupled/coupled" or "connected/connected" used in the specification of this application (including the claims) may refer to any direct or indirect connection means. For example, "a first device is coupled to a second device" should be interpreted as "the first device is directly connected to the second device" or "the first device is indirectly connected to the second device through other devices or connection means". The term "signal" may refer to current, voltage, charge, temperature, data, electromagnetic wave, or any one or more signals. In addition, the term "and/or" may mean "at least one of". For example, "the first signal and/or the second signal" should be interpreted as "at least one of the first signal and the second signal".

Figure 2:
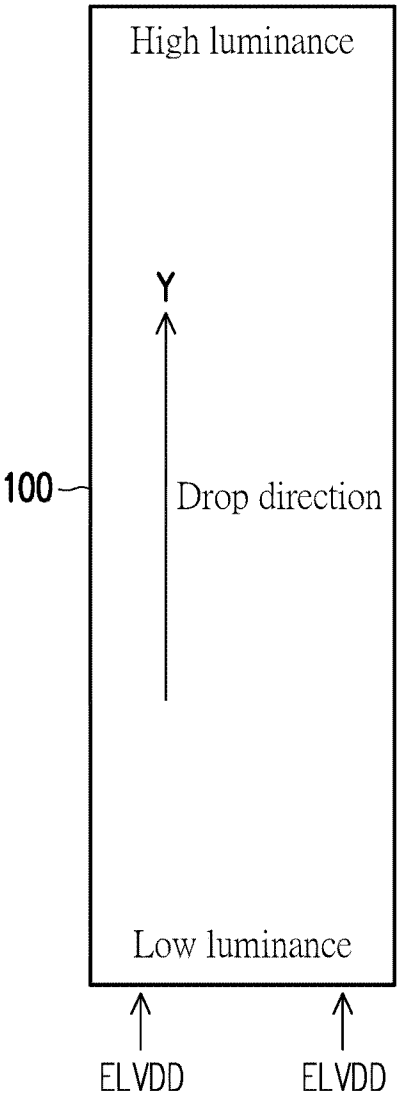
FIG. 2 is a schematic diagram of luminance drop of the display panel in the embodiment of FIG. 1.
Figure 1:
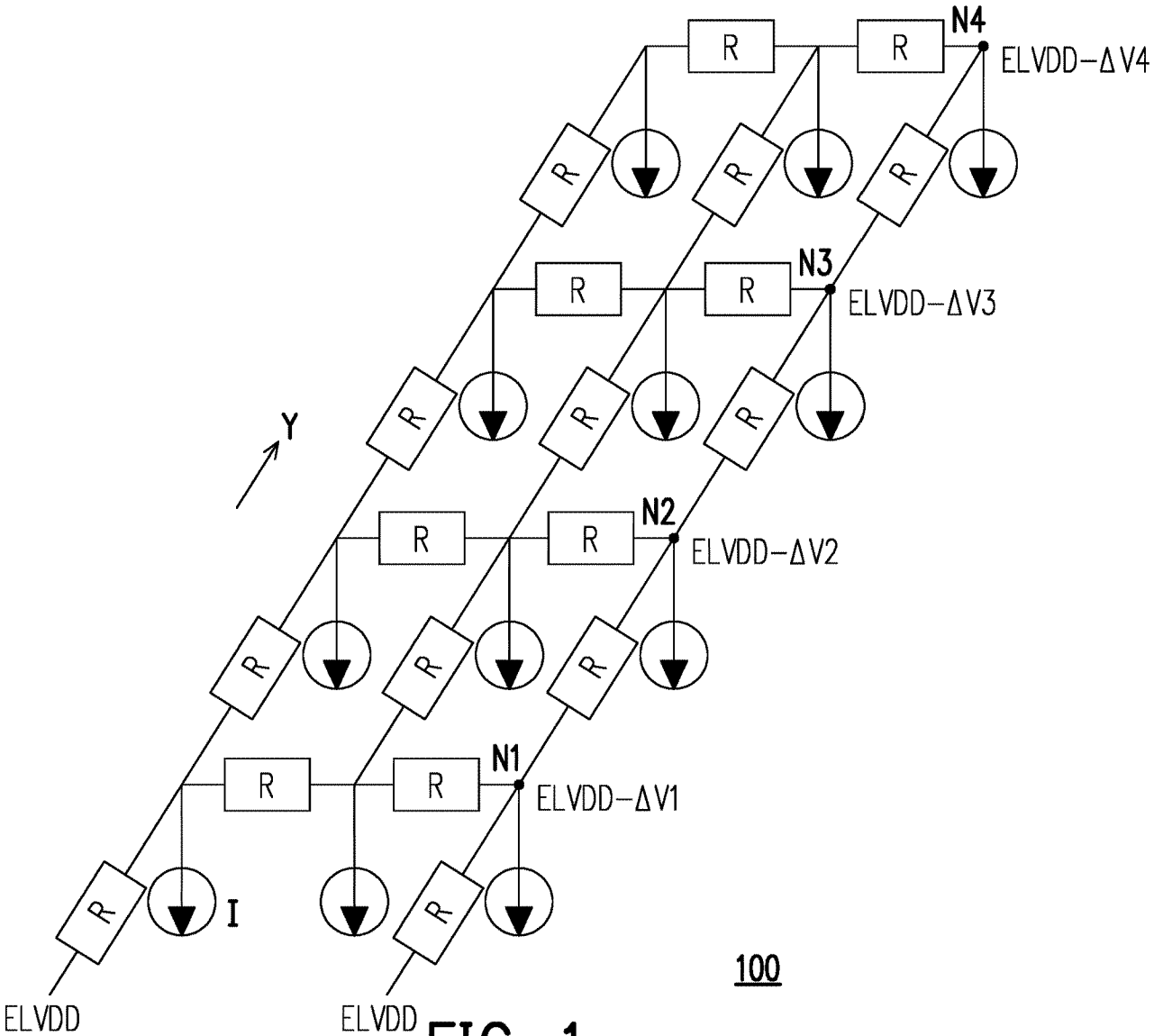
FIG. 1 is a schematic diagram of a display panel according to an embodiment of the invention.

FIG. 1 is a schematic diagram of a display panel according to an embodiment of the invention. FIG. 2 is a schematic diagram of luminance drop of the display panel in the embodiment of FIG. 1. Referring to FIG. 1 and FIG. 2, a display panel 100 of the embodiment may be a current driving display panel, such as an organic light-emitting diode (LED) display panel, a mini LED display panel, and a micro LED display panel, or a quantum dot (QD) LED display panel.

Pixels and power supply trace on the display panel 100 may be equivalent to a circuit structure in which a plurality of resistors R and a plurality of currents I are connected in series and/or in parallel, as shown in FIG. 1. A power supply ELVDD is an operating voltage provided to each of the pixels on the display panel 100. The display panel 100 may have different degrees of IR drops at different positions of the power supply trace due to changes in display content. For example, on the power supply trace, nodes spaced from the power supply ELVDD from near to far away are respectively N1, N2, N3, and N4. The IR drops of the nodes N1, N2, N3, and N4 are respectively $\Delta V1$, $\Delta V2$, $\Delta V3$, and $\Delta V4$. Therefore, under the condition of the same display content, the pixels may present different degrees of variations due to the different distances with the power supply ELVDD, resulting in a difference between a display luminance and an expected luminance of the pixels, or unsatisfactory phenomena such as uneven luminance, color deviation, etc. For example, in FIG. 2, in a drop direction Y, the display luminance of the pixel becomes lower as the distance from the power supply ELVDD is farther.

The display driving circuit of the embodiment of the invention uses the display driving method provided by the embodiment of the invention to drive the display panel, and the display luminance of the pixels may be more consistent with the expected luminance, and undesirable phenomena such as luminance unevenness, color deviation, etc., may be eliminated.

Figure 3:
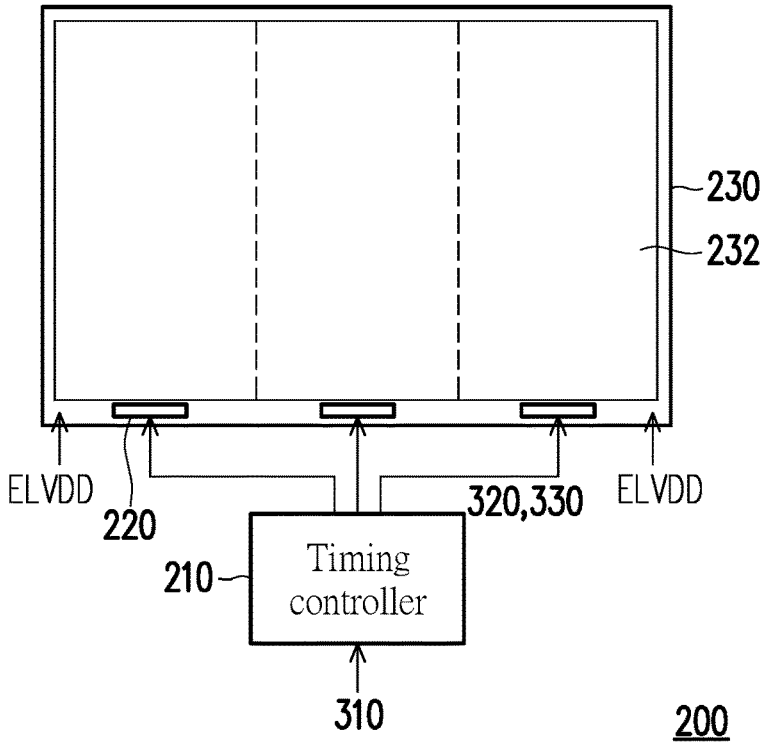
FIG. 3 is a schematic diagram of a display apparatus according to an embodiment of the invention.

FIG. 3 is a schematic diagram of a display apparatus according to an embodiment of the invention. Referring to FIG. 3, the display apparatus 200 includes a timing controller 210, one or a plurality of display driving circuits 220 and a display panel 230. The timing controller 210 is configured to control the display driving circuits 220 to drive the display panel 230 to display a video. The video includes a plurality of frames. The timing controller 210 is configured to receive video data 310 and analyze content of each frame of the video according to the video data 310 to generate a voltage compensation map 320 of each frame. The timing controller 210 then outputs the voltage compensation map 320 to each display driving circuit 220.

The display driving circuit 220 is coupled to the timing controller 210. The display driving circuit 220 is configured to receive the voltage compensation map 320 and a pixel line address 330 from the timing controller 210. By lines, the display driving circuit 220 may determine a voltage compensating value (for example, a voltage compensating value ΔVg shown in FIG. 5 and FIG. 6) of each pixel line according to the voltage compensation map 320 of each frame and the pixel line address 330. Then, the display driving circuit 220 generates a compensated gamma curve (a first gamma curve) of each pixel line according to the voltage compensating value ΔVg.

The display panel 230 is coupled to the display driving circuit 220. The display panel 230 includes one or a plurality of display regions 232. The display driving circuit 220 generates a gamma voltage of each pixel line according to the compensated gamma curve to drive the respective display regions 232 to display the video. In the embodiment, the display apparatus 200, for example, includes three display driving circuits 220, and corresponding to the number of the display driving circuits 220, the display panel 230 is also divided into three display regions 232, but the number thereof is not used for limiting the invention. In an embodiment, the display apparatus 200 may also include only one display driving circuit 220 for driving the entire display region of the display panel 230.

The following describes how the timing controller 210 generates the voltage compensation map 320 of each frame.

Figure 4:
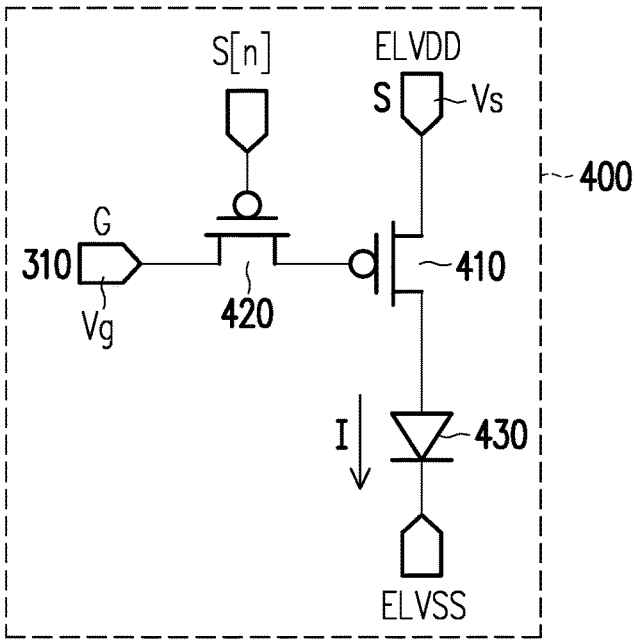
FIG. 4 is a schematic diagram of a pixel circuit on a display panel of the embodiment in FIG. 3.

FIG. 4 is a schematic diagram of a pixel circuit on a display panel of the embodiment in FIG. 3. Referring to FIG. 4, the display panel 230 includes a plurality of pixel circuits 400. The pixel circuit 400 includes a driving transistor 410, a scan transistor 420, and an LED 430. A source terminal S of the driving transistor 410 is coupled to the power supply ELVDD, and a cathode terminal of the LED 430 is coupled to another power supply ELVSS. A gate terminal G of the driving transistor 410 is coupled to the video data 310. The scan transistor 420 is coupled to a scan signal S[n]. The scan signal S[n] is a signal applied to an $n^{th}$ scan line to control a conduction state of the scan transistor 420, where n is a natural number. When the scan transistor 420 is turned on, the video data 310 may be written into the pixel circuit 400, and the driving transistor 410 may generate a driving current I according to the video data 310 to drive the LED 430 to display a corresponding video.

Figure 5:
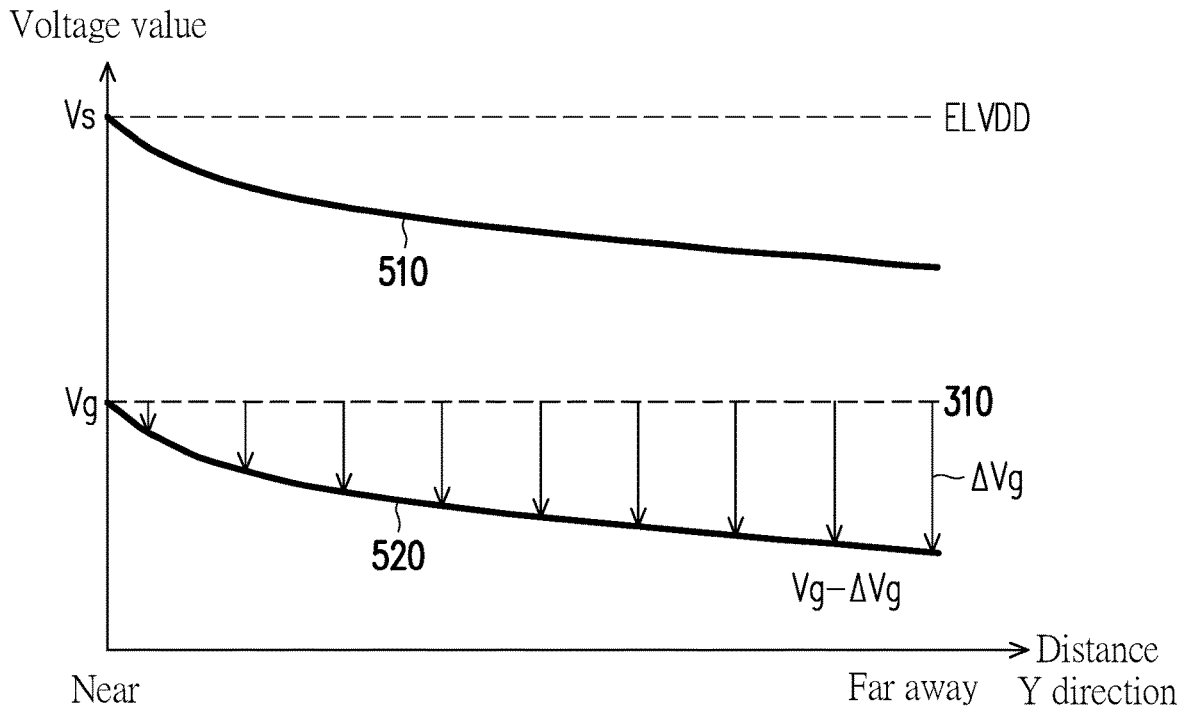
FIG. 5 is a curve diagram of voltage variations of a source terminal and a gate terminal of a driving transistor in the embodiment of FIG. 4.
Figure 6:
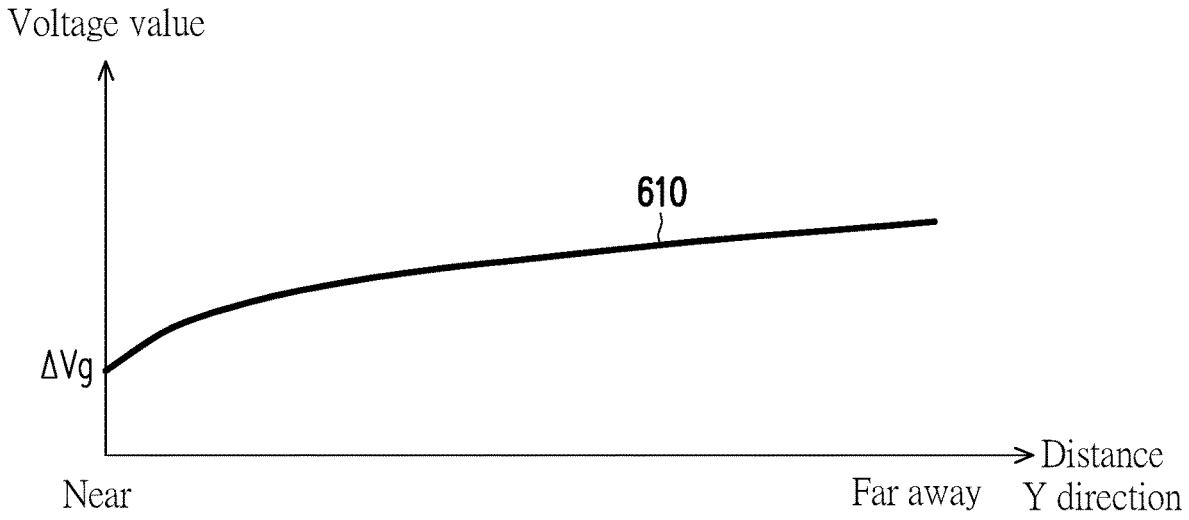
FIG. 6 is a curve diagram of a voltage compensating value of the driving transistor in the embodiment of FIG. 4

FIG. 5 is a curve diagram of voltage variations of the source terminal and the gate terminal of the driving transistor in the embodiment of FIG. 4. FIG. 6 is a curve diagram of the voltage compensating value of the driving transistor in the embodiment of FIG. 4, where a horizontal axis of FIG. 5 and FIG. 6 represents distances between each pixel line and the power supply ELVDD in the Y direction, and a vertical axis represents voltage values. Referring to FIG. 4 to FIG. 6, a voltage Vs represents a voltage of the source terminal S of the driving transistor 410, and a voltage Vg represents a voltage of the gate terminal G of the driving transistor 410. Since there are different degrees of IR drops at different positions of the power supply trace, a change of the voltage Vs is shown as a curve 510. The closer to the power supply ELVDD, the less degree of the IR drop; and the farther to the power supply ELVDD, the higher degree of the IR drop.

On the other hand, after the video data 310 is written into the pixel circuit 400, the voltage Vg of the gate terminal G of the driving transistor 410 presents a pattern as shown by a dashed line 310 in FIG. 5. The dashed line 310 is a target value of the video data 310 written into the pixel circuit 400, i.e., a voltage value before compensation. The compensated voltage Vg is shown by a curve 520, which has a same shift amount as that of the curve 510 of the voltage Vs. Therefore, a voltage difference Vsg between the source terminal S and the gate terminal G of the driving transistor 410 may be compensated to an ideal value, and the voltage difference Vsg may be the same even at different positions of the power supply trace. At different positions of the power supply trace, the shift amount between the curve 520 and the dashed line 310 is ΔVg, which is illustrated as a curve 610 as shown in FIG. 6. The shift amount ΔVg is used as a voltage compensating value to compensate the voltage Vg of the gate terminal G of the driving transistor 410. After being compensated, the voltage Vg may present a changing trend as the curve 520, and the changing trend is the same as the curve 510. Therefore, the compensated voltage Vg and the curve 510 of the voltage Vs have the same shift amount, and the different voltage difference Vsg of the driving transistor 410 therein due to different positions of the pixel circuit 400 at the power supply trace is avoided.

Figure 7:
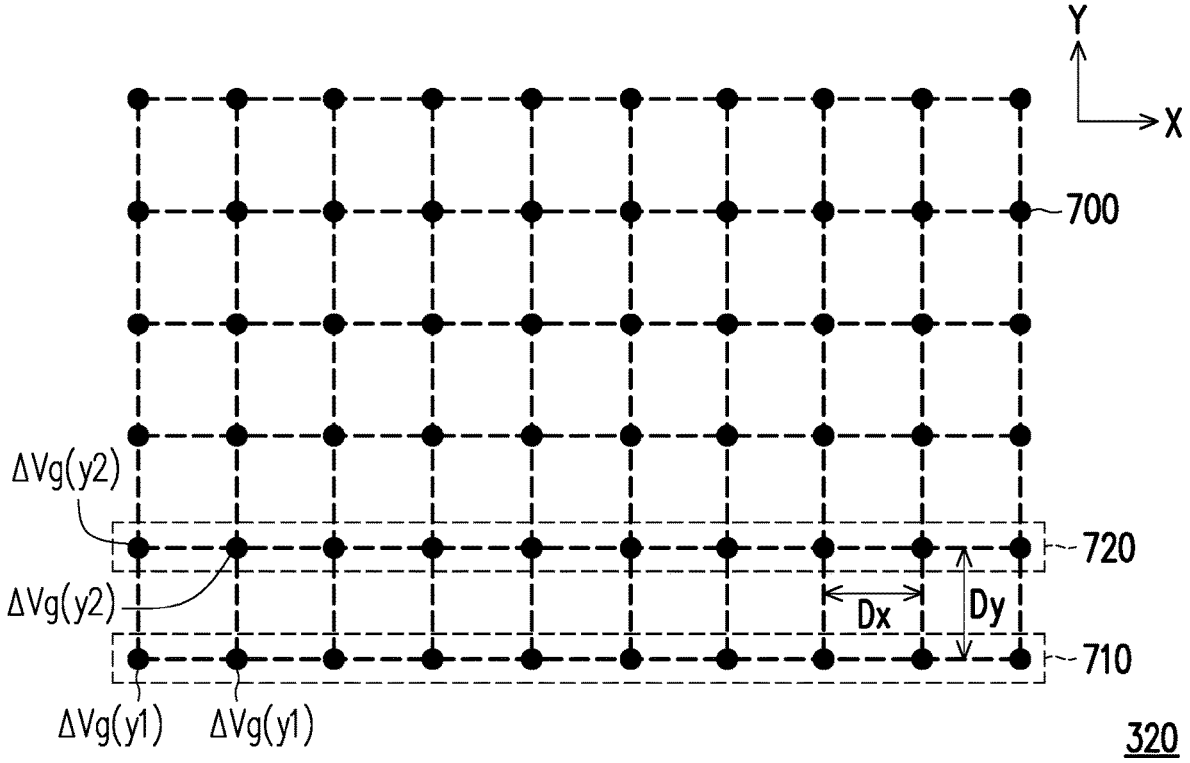
FIG. 7 is a schematic diagram of a voltage compensation map according to an embodiment of the invention.

FIG. 7 is a schematic diagram of a voltage compensation map according to an embodiment of the invention. Referring to FIG. 3 and FIG. 7, the timing controller 310 may analyze the content of each frame of the video according to the video data 310 to generate a voltage compensation map of each frame. Specifically, the timing controller 210 may include a content analysis circuit (not shown) for performing a video content analysis function. The timing controller 210 receives the video data 310 and analyzes a content loading of each pixel in the video data 310, where the content loading of the pixel depends on an equivalent resistance of the power supply trace from the power source ELVDD (i.e., a power supply source) to the pixel location, for example, the resistances R shown in FIG. 1. In other words, the farther the pixel position is from the power supply ELVDD, the greater the content loading of the pixel is.

Therefore, the voltage compensating value ΔVg obtained after analysis is used to compensate the video data 310 to generate compensated video data, where the compensated video data may make the display luminance of the pixel to be more consistent with the expected luminance, and may eliminate the undesirable phenomena of uneven luminance, color deviation, etc.

Therefore, the timing controller 310 may predict a drop trend of the voltage Vs by analyzing the content loading. Based on such trend, the timing controller 310 may estimate the voltage compensating values ΔVg required by the voltages Vg of the gate terminals G of the driving transistors 410 in the pixel circuits 400 at different positions, so as to form the voltage compensation map 320 of each frame, as shown in FIG. 7. Since the timing controller 310 analyzes the content of each frame according to the video data 310 to generate the voltage compensation map, the voltage compensating value ΔVg of the voltage compensation map 320 of each frame may be the same or different, which depends on the content of each frame.

In FIG. 7, the voltage compensation map 320 is a table including a plurality of pixel points 700 (first pixel points)

and voltage compensating values ΔVg thereof. For example, the voltage compensating value of the pixel points 700 on a first pixel line 710 is indicated as ΔVg(y1); the voltage compensating value of the pixel points 700 on a second pixel line 720 is indicated as ΔVg(y2); indication of the voltage compensating values of the remaining pixel lines may be deduced by analogy. In addition, Dy represents a distance between two adjacent pixels in the Y direction; Dx represents a distance between two adjacent pixels in an X direction.

Figure 8:
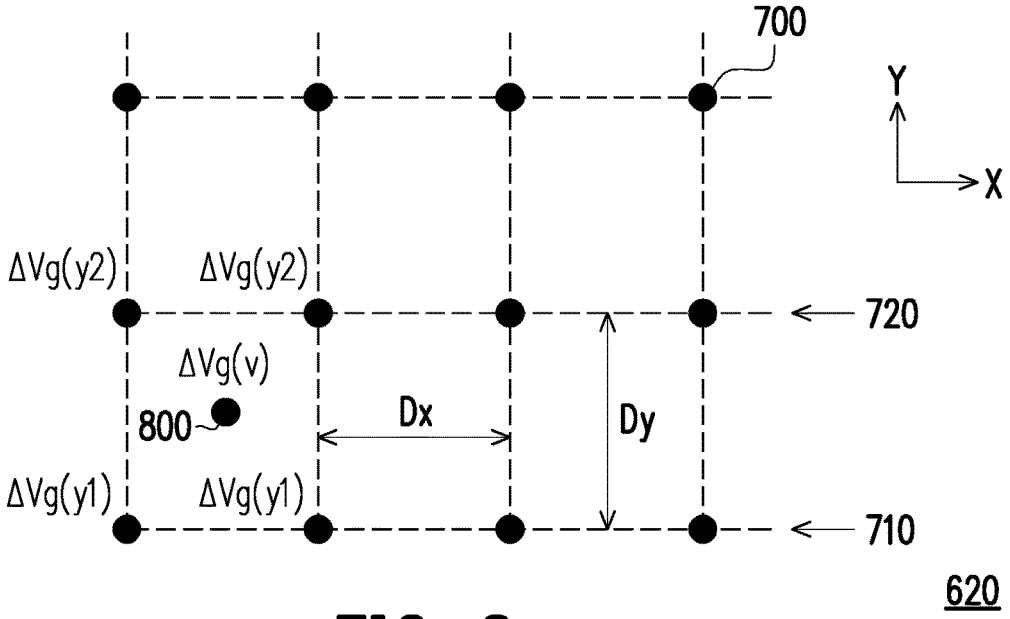
FIG. 8 is a schematic diagram of a voltage compensation map according to another embodiment of the invention.

FIG. 8 is a schematic diagram of a voltage compensation map according to another embodiment of the invention. Referring to FIG. 7 and FIG. 8, a voltage compensation map 620 of the embodiment further includes voltage compensating values ΔVg(v) of a plurality of second pixels 800. For clarity's sake, FIG. 8 only shows one second pixel 800, but it does not used for limiting the invention.

The timing controller 210 may perform an interpolation operation on the voltage compensating values ΔVg(y1) and ΔVg(y2) of the plurality of first pixel points 700 to generate the voltage compensating value ΔVg(v) of the second pixel point 800. Specifically, the timing controller 210 may, for example, calculate the voltage compensating value ΔVg(v) of the second pixel 800 by using a following interpolation equation: $\Delta Vg(v)=\Delta Vg(y1)+[\Delta Vg(y2))-\Delta Vg(y1)](v-y1)/Dy$, where (v-y1) represents a distance between the second pixel 800 and the pixel on the first pixel line 710 in the Y direction.

Namely, the voltage compensation map 320 of FIG. 7 may not include the voltage compensating value of each pixel, and the timing controller 210 may calculate the voltage compensation map 620 of FIG. 8 by using the interpolation operation, and the voltage compensation map 620 may include the voltage compensating values of more pixel points, so that the compensated video quality is better. In an embodiment, the voltage compensation map 320 of FIG. 7 may also include the voltage compensating value of each pixel on the display panel. In this case, the timing controller 210 does not need to use the interpolation operation to calculate the voltage compensating value, and a high-quality compensation video is also obtained.

Therefore, the timing controller 210 outputs the voltage compensation map 320 or 620 of each frame and the pixel line address 330 to the display driving circuit 220, and by lines, the display driving circuit 220 may determine the voltage compensating value ΔVg of each pixel line according to the voltage compensation map 320 or 620 of each frame and the pixel line address 330. Then, the display driving circuit 220 generates a compensated gamma curve of each pixel line according to the voltage compensating value ΔVg.

Figure 9:
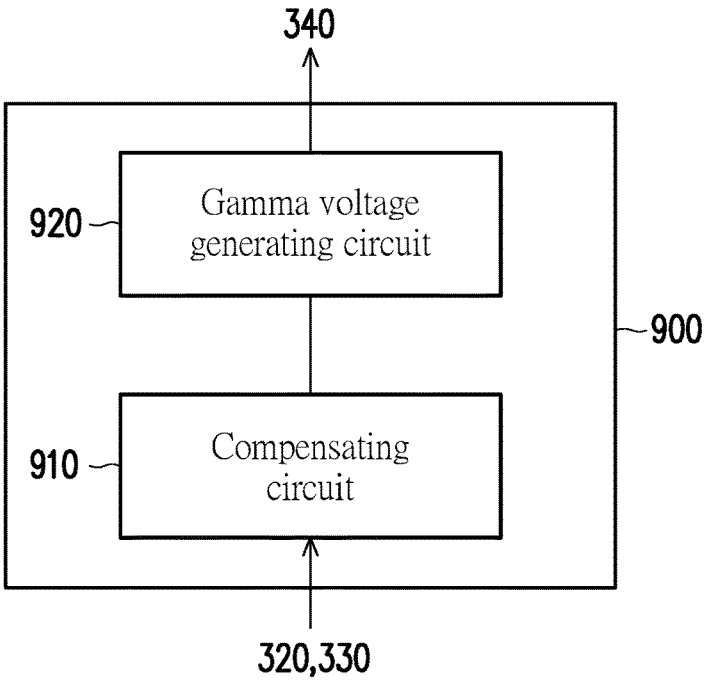
FIG. 9 is a schematic diagram of a display driving circuit according to an embodiment of the invention.
Figure 10:
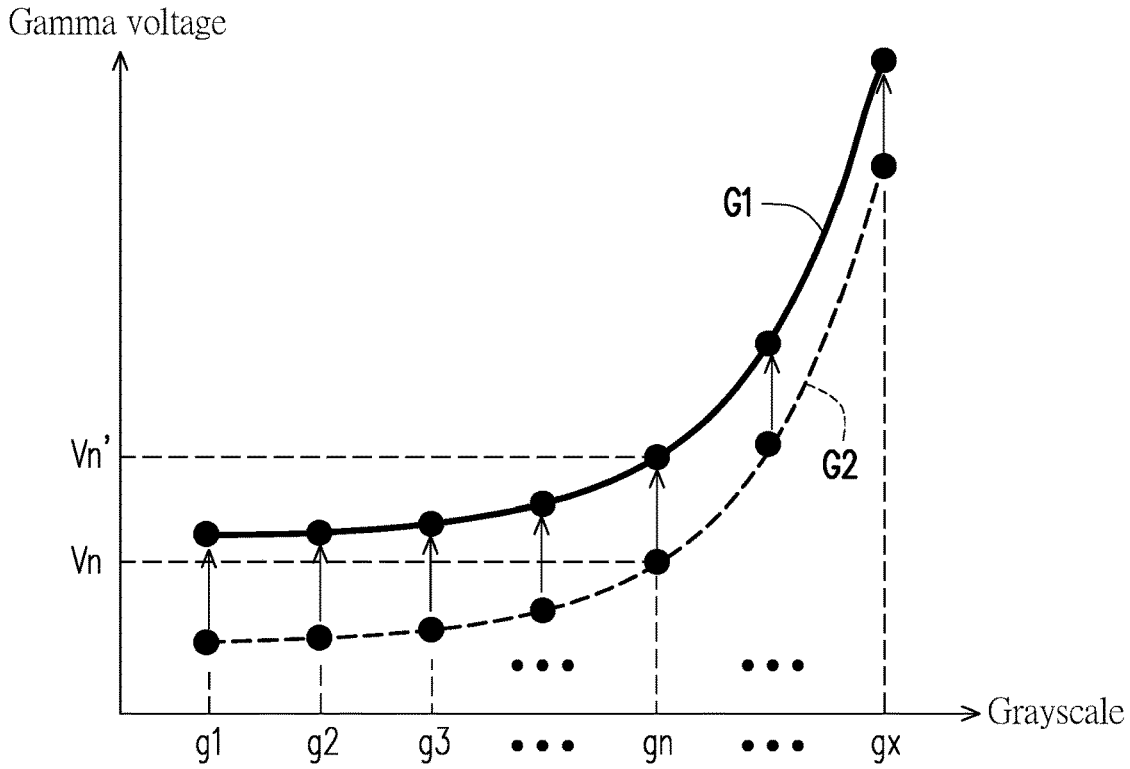
FIG. 10 is a schematic diagram of a gamma curve of the embodiment in FIG. 9.

FIG. 9 is a schematic diagram of a display driving circuit according to an embodiment of the invention. FIG. 10 is a schematic diagram of a gamma curve of the embodiment in FIG. 9. Referring to FIG. 9 and FIG. 10, a display driving circuit 900 is, for example, used to drive the display panel 230 to display a video. The display driving circuit 900 includes a compensating circuit 910 and a gamma voltage generating circuit 920. The compensating circuit 910 is coupled to the timing controller 210. The compensating circuit 910 receives the voltage compensation map 320 of each frame of the video and the pixel line address 330 from the timing controller 210. The compensating circuit 910 determines the voltage compensating value ΔVg of each pixel line according to the voltage compensation map 320 of each frame and the pixel line address 330. The compensating circuit 910 generates a compensated gamma curve G1 (the first gamma curve) of each pixel line according to the voltage compensating value ΔVg. The gamma voltage generating circuit 920 is coupled to the compensating circuit 910. The gamma voltage generating circuit 920 generates a gamma voltage 340 of each pixel line according to the compensated gamma curve G1 to drive the display panel 230 to display a video.

In the embodiment, the gamma voltage generating circuit 920 is, for example, a programmable gamma correction buffer circuit chip (P-Gamma), which has a fixed gamma voltage setting value or may automatically adjust the gamma voltage setting value through software, and the invention does not limit the type of the gamma voltage generating circuit. Before the compensation, the gamma voltage generating circuit 920, for example, has a gamma curve G2 (a second gamma curve) as shown in FIG. 10. The gamma curve G2 before compensation includes different grayscale values g1, g2, g3, . . . , gn, . . . , gx, and each grayscale value corresponds to a different gamma voltage setting value, where n and x are natural numbers, and $1<n<x$. For example, the grayscale value gn corresponds to a gamma voltage setting value Vn. After the compensation, the gamma curve G2 is shifted upward according to the voltage compensating value ΔVg, and is adjusted to the gamma curve G1. In the compensated gamma curve G1, the grayscale values g1, g2, g3, . . . , gn, . . . , gx correspond to the compensated gamma voltage setting values. For example, the grayscale value gn corresponds to the compensated gamma voltage setting value Vn', and the remaining grayscale values also correspond to the compensated gamma voltage setting values. Therefore, the gamma voltage generating circuit 920 generates the gamma voltage 340 of each pixel line according to the compensated gamma curve G1, so as to drive the display panel 230 to display a video.

Namely, the gamma voltage generating circuit 920 includes the gamma curve G2, and the compensating circuit 910 adjusts the gamma curve G2 before compensation according to the voltage compensating value ΔVg, so as to generate the compensated gamma curve G1 of each pixel line.

Therefore, the compensating circuit 910 may learn which pixel line is to be currently driven by the display driving circuit 900 according to the pixel line address 330, and determine the voltage compensating value ΔVg of such pixel line according to the voltage compensation map 320 of each frame, so as to compensate the gamma curve G2 to the gamma curve G1. Then, the gamma voltage generating circuit 920 generates and outputs the gamma voltage 340 of each pixel line to a next stage circuit (such as a digital-to-analog converter circuit) according to the gamma curve G1.

In the embodiment, since the compensated gamma curve is determined according to the voltage compensation map of each frame, different pixel lines may correspond to the same or different compensated gamma curves. In addition, pixel data of different colors may also correspond to the same or different compensated gamma curves. For example, each pixel of the display panel may contain a red sub-pixel, a green sub-pixel, and a blue sub-pixel used for displaying red data (red grayscale value), green data (green grayscale value) and blue data (blue grayscale value) of the pixel data. Therefore, pixel data corresponding to different colors has different compensated gamma curves to determine gamma voltages thereof.

In an embodiment, the display driving circuit 900 may further include the timing controller 210 for analyzing the content of each frame according to the video data 310, so as to generate the voltage compensation map 320 of each frame, and output the voltage compensation map 320 and the pixel line address 330 to compensating circuit 910.

In the embodiment, regarding a component hardware structure in the embodiment of FIG. 9, the compensating circuit 910 is, for example, a digital circuit, which may be implemented by hardware description language (HDL) or any other design method for digital circuits that is familiar to those skilled in the art, and may be a hardware circuit implemented through field programmable gate array (FPGA), complex programmable logic device (CPLD) or application-specific integrated circuit (ASIC). In addition, sufficient teachings, suggestions, and implementation descriptions for the hardware structure of the gamma voltage generating circuit 920 may be learned from common knowledge of the relevant technical field.

Figure 11:
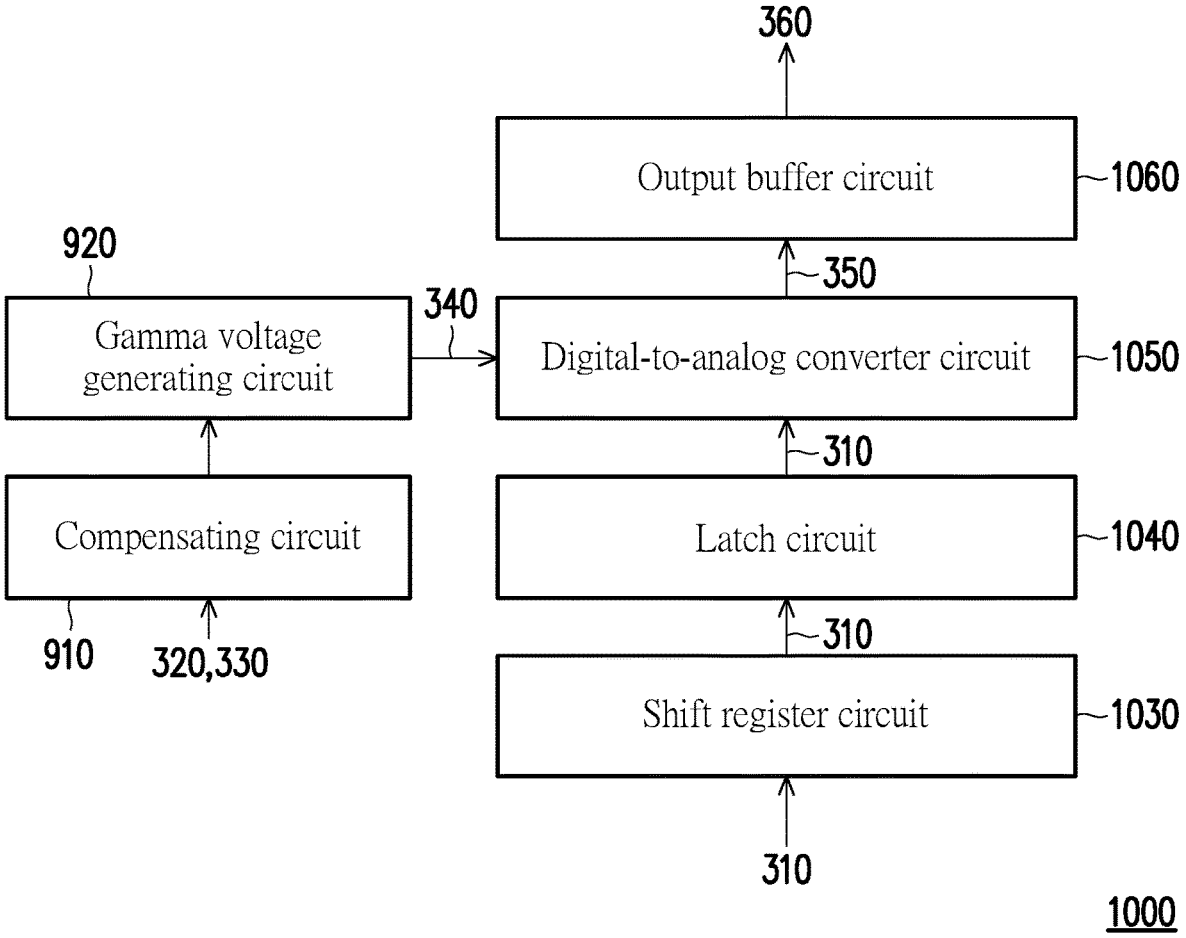
FIG. 11 is a schematic diagram of a display driving circuit according to another embodiment of the invention.

FIG. 11 is a schematic diagram of a display driving circuit according to another embodiment of the invention. Referring to FIG. 11, a display driving circuit 1000 of the embodiment is used to drive the display panel 230 to display a video. The display driving circuit 1000 includes the compensating circuit 910, the gamma voltage generating circuit 920, a shift register circuit 1030, a latch circuit 1040, a digital-to-analog converter circuit 1050, and an output buffer circuit 1060. In addition to outputting the video data 310 to the shift register circuit 1030, the timing controller 210 also outputs the voltage compensation map 320 of each frame and the pixel line address 330 to the compensating circuit 910.

The video data 310 is input to the digital-to-analog converter circuit 1050 through the shift register circuit 1030 and the latch circuit 1040. The gamma voltage generating circuit 920 provides the gamma voltage 340 to the digital-to-analog converter circuit 1050 to perform a digital-to-analog conversion operation. The digital-to-analog converter circuit 1050 converts the video data 310 into an analog signal 350 according to the gamma voltage 340, and provides the analog signal 350 to the output buffer circuit 1060. Then, the output buffer circuit 1060 generates a driving signal 360 according to the analog signal 350 to drive the display panel 230 to display a video.

In an embodiment, since the gamma voltage 340 is generated according to the compensated gamma curve, when the driving signal 360 drives the display panel 230, the display luminance of the pixel may be relatively consistent with the expected luminance, and the undesirable phenomena such as uneven luminance, color deviation, etc., may be eliminated.

Figure 12:
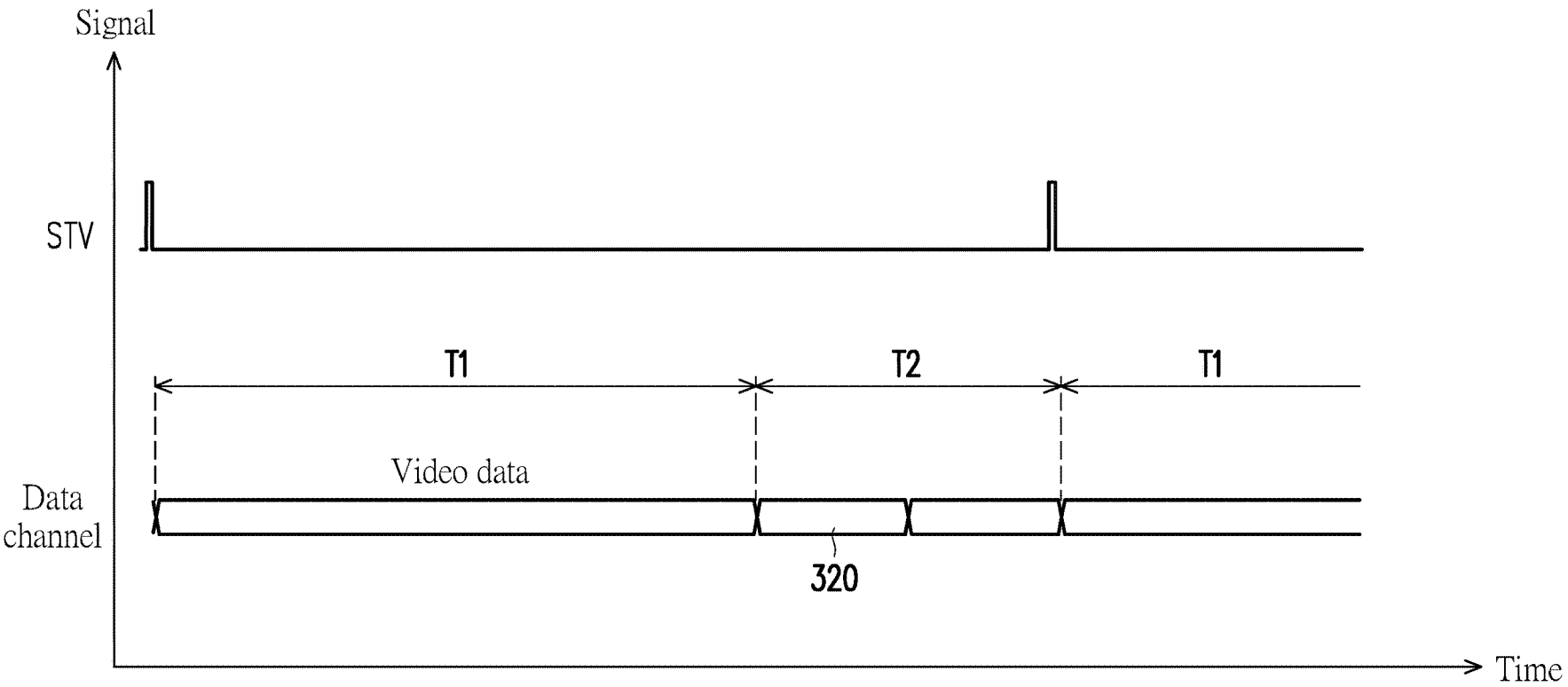
FIG. 12 is a signal timing diagram of a display driving circuit in different operation periods according to an embodiment of the invention.

FIG. 12 is a signal timing diagram of a display driving circuit in different operation periods according to an embodiment of the invention. Referring to FIG. 12, a time interval between every two start signals STV is a frame period. During each frame period, an operation period of the display driving circuit 220 includes an active period T1 and a vertical blanking period T2. The display driving circuit 220 drives the display panel 230 to display a video according to the video data 310 during the active period T1. The timing controller 210 may output the voltage compensation map 320 of each frame to the compensating circuit 910 during the vertical blanking period T2. The timing controller 210 may output the pixel line address 330 to the compensating circuit 910 during the active period T1 or the vertical blanking period T2.

To be specific, in FIG. 12, the timing controller 210 outputs the voltage compensation map 320 of each frame to the compensating circuit 910 in a front stage of the vertical blanking period T2, but the invention is not limited thereto. The timing controller 210 may output the voltage compensation map 320 of each frame to the compensating circuit 910 in any interval in the vertical blanking period T2. Then, the timing controller 210 updates the pixel line address 330 in the compensating circuit 910 by lines during the active period T1. Therefore, the compensating circuit 910 may determine the voltage compensating value $\Delta Vg$ of each pixel line according to the voltage compensation map 320 of each frame and the pixel line address 330.

Alternatively, the timing controller 210 may also output the pixel line address 330 to the compensating circuit 910 during the vertical blanking period T2 to update an initial pixel line address in the compensating circuit 910. Thereafter, the compensating circuit 910 automatically counts according to the initial pixel line address to learn the pixel line currently to be driven.

Figure 13:
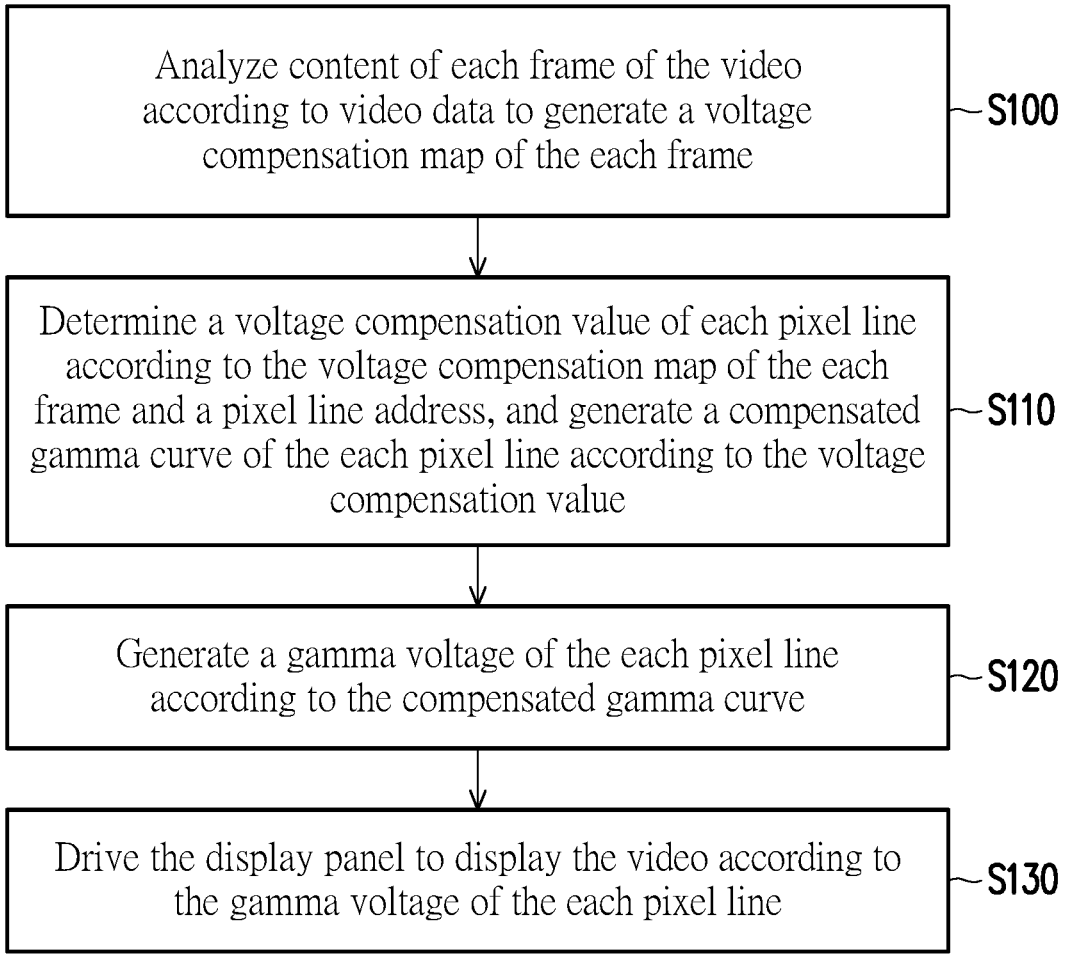
FIG. 13 is a step flowchart of a display driving method according to an embodiment of the invention.

FIG. 13 is a step flowchart of a display driving method according to an embodiment of the invention. Referring to FIG. 3 and FIG. 13, the display driving method of the embodiment is at least suitable for the display apparatus 200 of FIG. 3, but the invention is not limited thereto. Taking the display apparatus 200 as an example, in step S100, the timing controller 210 analyzes the content of each frame of the video according to the video data 310 to generate the voltage compensation map 320 of each frame. In step S110, the display driving circuit 220 determines the voltage compensating value of each pixel line according to the voltage compensation map 320 of each frame and the pixel line address 330, and generates a compensated gamma curve of each pixel line according to the voltage compensating value. In step S120, the display driving circuit 220 generates a gamma voltage of each pixel line according to the compensated gamma curve. In step S130, the display driving circuit 220 drives the display panel 230 to display a video according to the gamma voltage of each pixel line. In addition, sufficient teachings, suggestions and implementation descriptions for the display driving method of the embodiment may be learned from the embodiments of FIG. 1 to FIG. 12, and details thereof are not repeated.

In summary, in the embodiment of the invention, the timing controller may acquire the content loading of each frame through data analysis and calculation, and generate the corresponding voltage compensation map. In addition to outputting video data, the timing controller also outputs the voltage compensation map and the pixel line address to the display driving circuit. The display driving circuit includes a compensating circuit, which is disposed in front of the gamma voltage generating circuit. The compensating circuit updates the original gamma curve of the gamma voltage generating circuit by lines according to the voltage compensation map and the pixel line address, so as to generate the compensated gamma curve. The gamma voltage generating circuit generates the gamma voltage according to the compensated gamma curve. The voltage compensation map may be updated to the display driving circuit during the vertical blanking period. Therefore, the display driving circuit applies the display driving method provided by the embodiments of the invention to drive the display panel, thereby the display luminance of the pixels is relatively consistent with the expected luminance, and the undesirable phenomena such as uneven luminance, color deviation, and the like are eliminated.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A display apparatus, configured to display a video, the display apparatus comprising:

a timing controller, configured to analyze content of each frame of the video according to video data to generate a voltage compensation map of the each frame of the video;

one or a plurality of display driving circuits, coupled to the timing controller, and configured to receive the voltage compensation map and a pixel line address from the timing controller, wherein the one display driving circuit or the display driving circuits determine a voltage compensating value of each pixel line according to the voltage compensation map of the each frame and the pixel line address, and the one display driving circuit or the display driving circuits generate a first gamma curve of the each pixel line according to the voltage compensating value; and a display panel, coupled to the one display driving circuit or the display driving circuits, and comprising one or a plurality of display regions, wherein the one display driving circuit or the display driving circuits generate a gamma voltage of the each pixel line according to the first gamma curve to drive the respective one display region or the display regions to display the video.

2. The display apparatus as claimed in claim 1, wherein the one display driving circuit or the display driving circuits comprise:

a compensating circuit, coupled to the timing controller, and configured to receive the voltage compensation map of the each frame and the pixel line address from the timing controller, wherein the compensating circuit determines the voltage compensating value of the each pixel line according to the voltage compensation map of the each frame and the pixel line address, and the compensating circuit generates the first gamma curve of the each pixel line according to the voltage compensating value; and a gamma voltage generating circuit, configured to generate the gamma voltage of the each pixel line according to the first gamma curve.

3. The display apparatus as claimed in claim 1, wherein the voltage compensation map of the each frame comprises the voltage compensating value of a plurality of first pixel points.

4. The display apparatus as claimed in claim 3, wherein the voltage compensation map of the each frame further comprises the voltage compensating value of a plurality of second pixel points, and the timing controller performs an interpolation operation on the voltage compensating value of the first pixel points to generate the voltage compensating value of the second pixel points.

5. The display apparatus as claimed in claim 1, wherein the timing controller outputs the voltage compensation map of the each frame to the compensating circuit during a vertical blanking period.

6. The display apparatus as claimed in claim 5, wherein the timing controller outputs the pixel line address to the compensating circuit during the vertical blanking period or an active period.

7. The display apparatus as claimed in claim 1, wherein the one display driving circuit or the display driving circuits comprise a second gamma curve, and the one display driving circuit or the display driving circuits adjust the second gamma curve according to the voltage compensating value to generate the first gamma curve of the each pixel line.

8. A display driving circuit, configured to drive a display panel to display a video, the display driving circuit comprising:

a compensating circuit, configured to receive a voltage compensation map of each frame of the video and a pixel line address from a timing controller, wherein the compensating circuit determines a voltage compensating value of each pixel line according to the voltage compensation map of the each frame and the pixel line address, and the compensating circuit generates a first gamma curve of the each pixel line according to the voltage compensating value; and a gamma voltage generating circuit, coupled to the compensating circuit, and configured to generate a gamma voltage of the each pixel line according to the first gamma curve.

9. The display driving circuit as claimed in claim 8, wherein the voltage compensation map of the each frame comprises the voltage compensating value of a plurality of first pixel points.

10. The display driving circuit as claimed in claim 9, wherein the voltage compensation map of the each frame further comprises the voltage compensating value of a plurality of second pixel points, and the voltage compensating value of the second pixel points is generated by performing an interpolation operation on the voltage compensating value of the first pixel points.

11. The display driving circuit as claimed in claim 8, wherein the compensating circuit receives the voltage compensation map of the each frame during a vertical blanking period.

12. The display driving circuit as claimed in claim 11, wherein the compensating circuit receives the pixel line address during the vertical blanking period or an active period.

13. The display driving circuit as claimed in claim 8, wherein the gamma voltage generating circuit comprises a second gamma curve, and the compensating circuit adjusts the second gamma curve according to the voltage compensating value to generate the first gamma curve of the each pixel line.

14. The display driving circuit as claimed in claim 8, further comprising the timing controller coupled to the compensating circuit, wherein the timing controller analyzes content of the each frame according to video data to generate the voltage compensation map of the each frame.

15. A display driving method, for driving a display panel to display a video, the display driving method comprising:

analyzing content of each frame of the video according to video data to generate a voltage compensation map of the each frame;

determining a voltage compensating value of each pixel line according to the voltage compensation map of the each frame and a pixel line address, and generating a first gamma curve of the each pixel line according to the voltage compensating value;

generating a gamma voltage of the each pixel line according to the first gamma curve; and driving the display panel to display the video according to the gamma voltage of the each pixel line.

16. The display driving method as claimed in claim 15, wherein the voltage compensation map of the each frame comprises the voltage compensating value of a plurality of first pixel points.

17. The display driving method as claimed in claim 16, wherein the voltage compensation map of the each frame further comprises the voltage compensating value of a plurality of second pixel points, and the display driving method further comprises:

performing an interpolation operation on the voltage compensating value of the first pixel points to generate the voltage compensating value of the second pixel points.

18. The display driving method as claimed in claim 15, wherein the step of generating the first gamma curve of the each pixel line according to the voltage compensating value comprises:

adjusting a second gamma curve according to the voltage compensating value to generate the first gamma curve of the each pixel line.

* * * * *